US008322285B2

(12) United States Patent
Zhong et al.

(10) Patent No.: US 8,322,285 B2
(45) Date of Patent: Dec. 4, 2012

(54) COMBINED FIREWORK

(75) Inventors: Ziyou Zhong, Hunan (CN); Yongzhang Liu, Hunan Province (CN); Weimin Zhong, Hunan (CN); Liang Zhong, Hunan (CN); Binbo Gong, Hunan Province (CN)

(73) Assignee: Ziyou Zhong, Hunan (CN)

( * ) Notice: Subject to any disclaimer, the term of this patent is extended or adjusted under 35 U.S.C. 154(b) by 105 days.

(21) Appl. No.: 12/840,639

(22) Filed: Jul. 21, 2010

(65) Prior Publication Data

US 2011/0017087 A1 Jan. 27, 2011

(30) Foreign Application Priority Data

Jul. 22, 2009 (CN) ..... 2009 1 0043962

(51) Int. Cl.
*F42B 4/00* (2006.01)
*F42B 4/20* (2006.01)

(52) U.S. Cl. ..... 102/358; 102/357; 102/360

(58) Field of Classification Search ..... 102/335, 102/336, 343, 345, 358, 360, 361, 357
See application file for complete search history.

(56) References Cited

U.S. PATENT DOCUMENTS

| | | | | |
|---|---|---|---|---|
| 4,325,304 | A * | 4/1982 | Ormiston | 102/200 |
| 5,036,769 | A * | 8/1991 | Schaff et al. | 102/221 |
| 5,429,053 | A * | 7/1995 | Walker | 102/342 |
| 6,393,990 | B1 * | 5/2002 | Fagan | 102/342 |

FOREIGN PATENT DOCUMENTS

| | | | |
|---|---|---|---|
| CN | 201034485 | Y * | 3/2008 |
| CN | 201093954 | Y * | 7/2008 |

* cited by examiner

*Primary Examiner* — James Bergin
(74) *Attorney, Agent, or Firm* — Scully, Scott, Murphy & Presser, P.C.

(57) ABSTRACT

A combined firework is disclosed. In the combined firework, several tubular holes whose central longitudinal axes are parallel to each other are uniformly distributed in a body, the tubular holes have openings upward and bottom ends closed. The closed end of the bottom of each tubular hole is provided with two small through holes penetrating through the bottom of the body and respectively provided with an inward fuse and an outward fuse in series connection. The body, the tubular holes and the small through holes thereof are an integrally molded structure. On the bottom in the tubular hole propellant powder is provided and connected with the outward fuse and the inward fuse. On the propellant powder an inner cylinder or effect powder is provided.

10 Claims, 3 Drawing Sheets

COMBINED FIREWORK

TECHNICAL FIELD

The present invention relates to the firework field, in particular, to a combined firework with an integrally molded outer cylinder.

BACKGROUND

The existing combined fireworks are ground firework products formed by combining a plurality of single cylinders and producing the effects such as sound, light, color and floating materials. The single-cylinder product generally is formed by outer cylinder, propellant powder, inner cylinder or effective powder, ignition fuse, spreading fuse, clay plug, base, etc. In manufacturing, the outer cylinders of a plurality of single-cylinder products are firstly combined and molded through the necessary processes such as cylinder rolling, mudding, bonding and ranking, fuse connecting, drying, combining, which last for one week and result in low efficiency, slow speed, and the cylinders are easily distorted and bent with nonstandard size, thus, the scale production and standardization of the firework industry is severely restricted. Moreover, the side face of the cylinder body should be manually drilled for forming the fuse hole in the procedure of fuse connecting, so that it is not easy to control the size of the hole and the distance between holes, which affects the launching time and launching effect of the product; in addition, the fuse of the formed product is at the sidewall of the cylinder body, which will easily lead to the fire hazard when firing due to the exposure of the fuse sparks.

SUMMARY

In order to overcome the above shortcomings, the technical problem to be solved by the present invention is: to provide a combined firework with an outer cylinder integrally molded, with standard specification, firm structure, high production efficiency, precise launching time and good safety. In order to solve the above technical problem, the technical solution used in the invention is: a combined firework, comprising a body, in which several tubular holes whose central longitudinal axes are parallel to each other are uniformly distributed, the tubular holes having openings upward and bottom ends closed, the closed end of the bottom of each tubular hole being provided with two small through holes penetrating through the bottom of the body; the two small through holes being respectively provided with an inward fuse and an outward fuse, the inward fuse of each tubular hole respectively being connected with the outward fuse of another adjacent tubular hole in sequence to form a series connection, except the inward fuse of the tubular hole at the head of the series connection and the outward fuse of the tubular hole at the end of the series connection, the inward fuse of the tubular hole at the head of the series connection extending out of the bottom of the body as the ignition fuse; the body, the tubular holes and the small through holes thereof being an integrally molded structure; on the bottom in the tubular hole propellant powder being provided and connected with the outward fuse and the inward fuse, on the propellant powder an inner cylinder or effect powder being provided.

In the above solution, since the body, the tubular holes and the small through holes thereof are an integrally molded structure, the firework has standard specification, firm structure and high production efficiency; moreover, as an important improvement, the original fuse connection at the side of the cylinder body is changed into the fuse connection at the bottom in the combined firework with the outer cylinder integrally molded in the present invention, and the fuse connecting holes are mechanically formed with a consistent size of hole and precisely controlled distance between holes, therefore, the launching time is accurate and safety is good.

The combined firework can be classified into single-type combined firework and multi-type combined firework. The single-type combined firework is formed by combining the single cylinders of the same type of effect, such as fountain type combined firework, bombette type combined firework, inner cylinder type combined firework; and the multi-type combined firework is formed by combining the single cylinders of different types of effects; the specifications and sizes of the outer cylinders of each specific product may be various, but the one-time integral molding can be accomplished by only correspondingly adjusting the processing moulds. However, according to an exemplary embodiment of the present invention, the sizes and shapes of the tubular holes are consistent.

According to an exemplary embodiment of the present invention, the outward fuse of the tubular hole at the end of the series connection can also extend out of the bottom of the body as a backup ignition fuse to remedy the failure of initial ignition.

As an improvement of the present invention, bottom wiring grooves are provided on the bottom of the body between the openings of the small through hole for inward fuse and the small through hole for outward fuse of two adjacent tubular holes for connecting the two openings so as to protect the fuse.

As an improvement of the present invention, a sidewall wiring groove for the ignition fuse is provided on the sidewall of the body so as to protect the fuse.

Since the fuse is provided at the bottom of the body, for the sake of waterproof and moistureproof in unfavorable environment or climate, as an improvement of the present invention, the bottom of the body is provided with a supporting structure, such as supporting leg, a supporting platform, or a supporting frame, to lift the body up from the ground. In order to further strengthen waterproof and protect the fuse against accidental damage, the bottom of the body is provided with a protective layer that preferably adopts the LDPE film, i.e. low density polyethylene film.

Likewise, the sidewalls and the top of the body also can be provided with the protective layers. However, since convenient printing should be considered for the top and the sidewalls, the protective layers preferably adopt the BOPP (BOPP is the abbreviation of "Biaxially Oriented Polypropylene") film.

DETAILED DESCRIPTION

Embodiment 1

Figure 1:
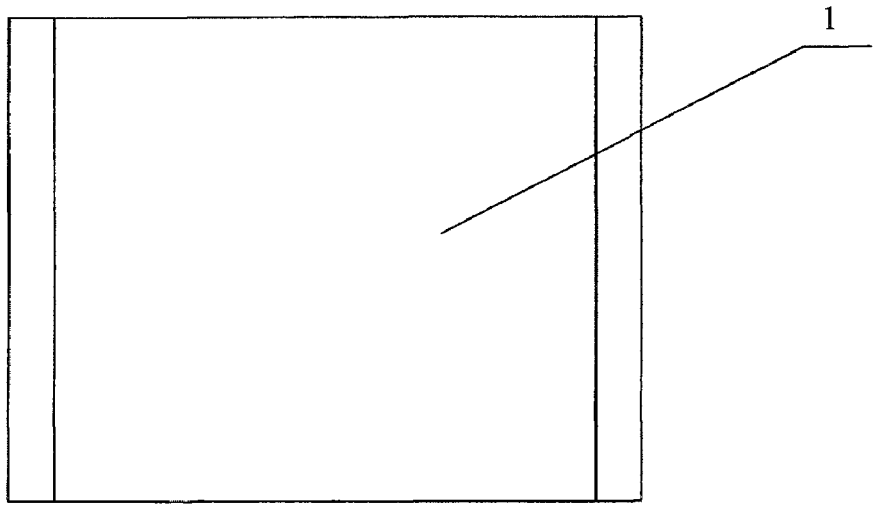
FIG. 1 is a front view of the schematic structure according to Embodiment 1.
Figure 2:
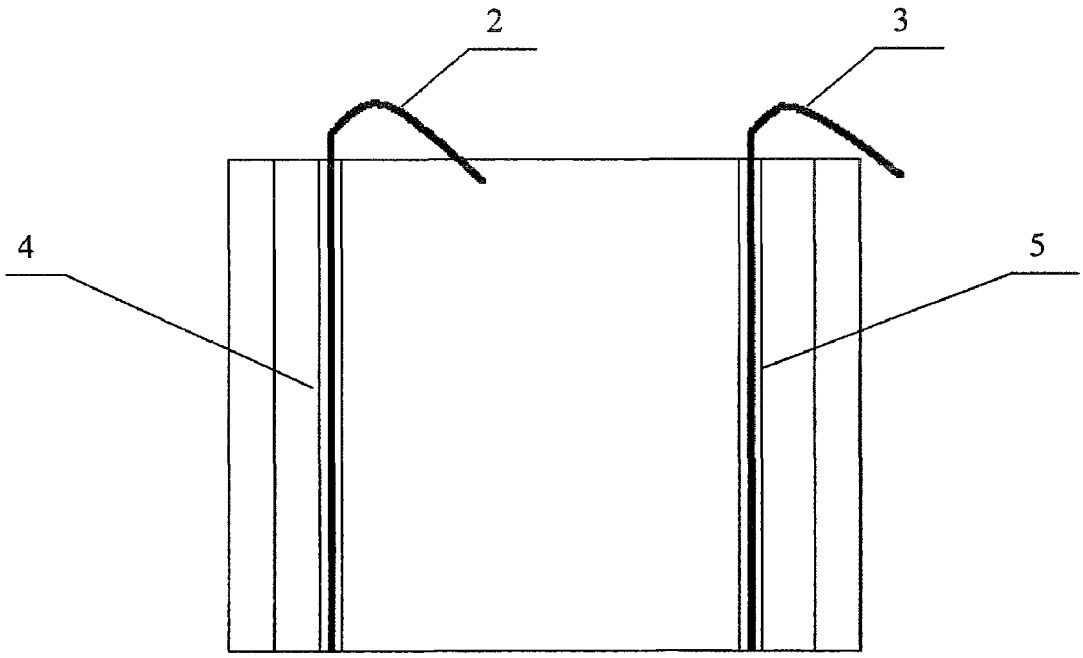
FIG. 2 is a left view of the schematic structure according to Embodiment 1.
Figure 3:
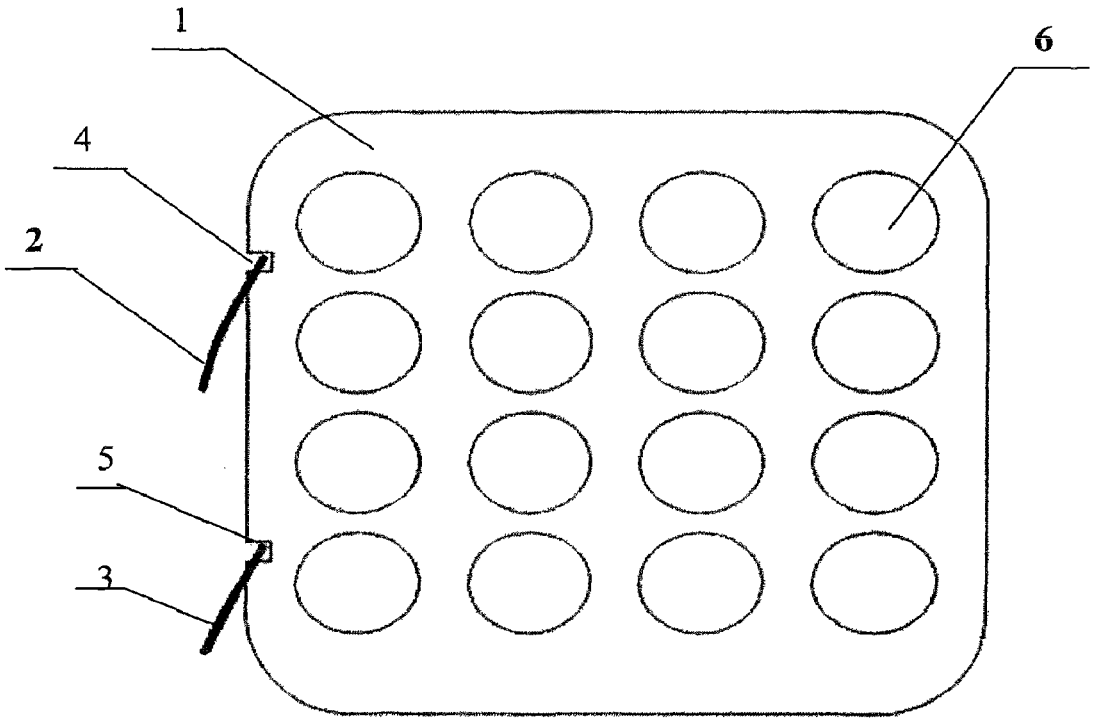
FIG. 3 is a top view of the schematic structure according to Embodiment 1.
Figure 4:
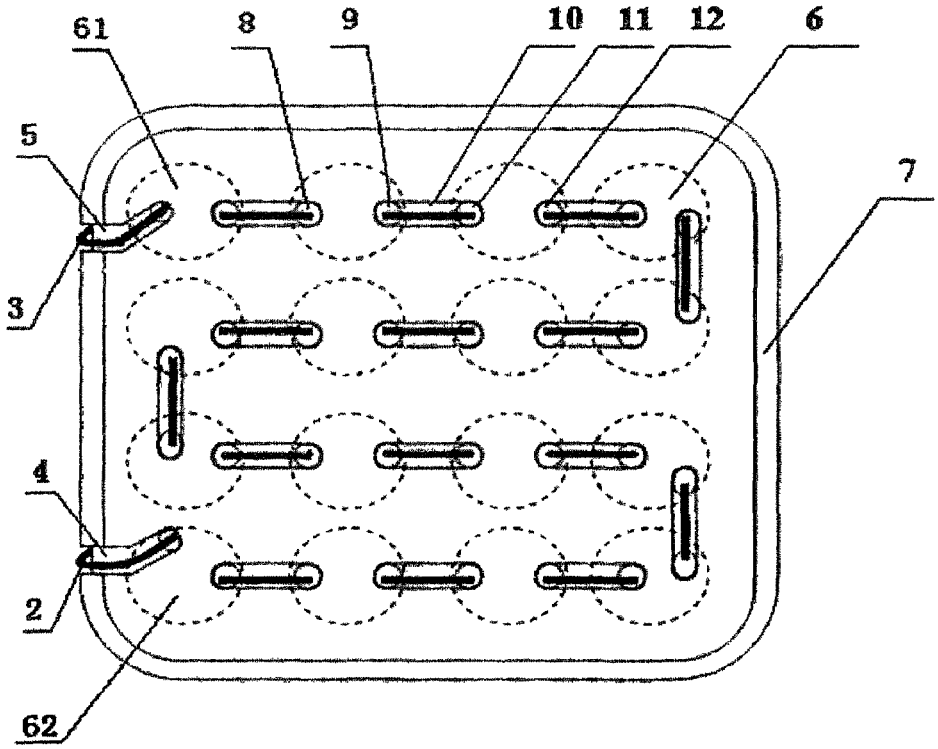
FIG. 4 is a bottom view of the schematic structure according to Embodiment 1.

Refer to FIGS. 1-4 that reflect an exemplary embodiment of the present invention. The combined firework comprises a rectangular body 1, in which 16 tubular holes 6 whose central longitudinal axes are parallel to each other are uniformly distributed, wherein, the tubular holes 6 have consistent size and shape and have openings upward and bottom ends closed. The closed end at the bottom of each tubular hole 6 is provided with two small through holes penetrating through the bottom of the body 1, for example, the small through hole 8 and the small through hole 9, and another example, the small through hole 11 and the small through hole 12.

The two small through holes are provided with an inward fuse and an outward fuse, respectively. For instance, the small through hole 8 and the small through hole 11 are provided with inward fuses, and the small through hole 9 and the small through hole 12 are provided with outward fuses; the inward fuse of each tubular hole respectively is connected with the outward fuse of another adjacent tubular hole in sequence. For example, the outward fuse of the tubular hole 61 is connected with the inward fuse of the small through hole 8, the outward fuse of the small through hole 9 is connected with the inward fuse of the small through hole 11, and the outward fuse of the small through hole 12 is connected with the inward fuse of the adjacent tubular hole, to form a series connection, except the inward fuse 3 of the tubular hole 61 at the head of the series connection and the outward fuse 2 of the tubular hole 62 at the end of the series connection. The inward fuse 3 of the tubular hole 61 at the head of the series connection extends out of the bottom of the body 1 as the ignition fuse 3, and the outward fuse 2 of the tubular hole 62 at the end of the series connection extends out of the bottom of the body 1 as the backup ignition fuse 2. During manufacturing, only a length of the fuse needs to be folded into a U shape, and the two feet of the U-shaped fuse are respectively inserted into the hole for inward fuse and the hole for outward fuse of two adjacent tubular holes, and the end of the U-shaped fuse is placed in the bottom wiring groove connecting the openings of the two holes, and the bottom wiring groove is applied with the composition of fixing fuse. Thus, the fuse connection between the two tubular holes is conveniently and quickly finished. For example, the small through hole 9 and the small through hole 11 are inserted with a length of fuse folded into a U shape. It can be seen that, according to an exemplary embodiment of the present invention, the small through hole for inward fuse and the small through hole for outward fuse of the two adjacent tubular holes are connected by a length of fuse folded into a U shape.

The body 1, the tubular holes 6 and the small through holes thereof are an integrally molded structure. On the bottom in the tubular holes 6, propellant powder is provided and connected with the ends of the outward fuses and the inward fuses extending into the tubular holes 6. On the propellant powder an inner cylinder or effect powder is provided. Bottom wiring grooves are provided on the bottom of the body 1 between the openings of the small through hole for inward fuse and the small through hole for outward fuse of two adjacent tubular holes 6 for connecting the two openings, for example, the connecting fuse between the small through hole 9; and the small through hole 11 is placed in the bottom wiring groove 10. A sidewall wiring groove 5 for the backup ignition fuse 3 and a wiring groove 4 for the backup ignition fuse 2 is provided on the sidewall of the body 1. The bottom of the body 1 is provided with a supporting frame 7, on which a bottom water proof layer is provided, and the bottom waterproof layer is LDPE film bonded onto the supporting frame 7 for integrally covering and sealing the bottom of the body 1. Meanwhile, the sidewalls and the top of the body 1 are integrally covered and sealed by the BOPP film.

Embodiment 2

Figure 5:
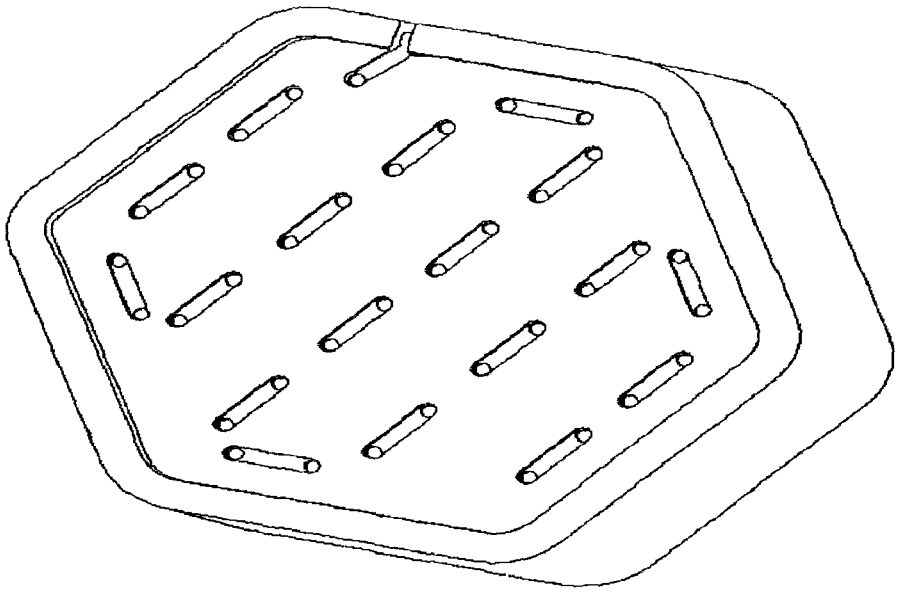
FIG. 5 is a structural scheme according to Embodiment 2.

Refer to FIG. 5, the embodiment 2 differs from Embodiment 1 in that the body is in a regular hexagon shape, and that the number of the tubular holes is 19.

Embodiment 3

Figure 6:
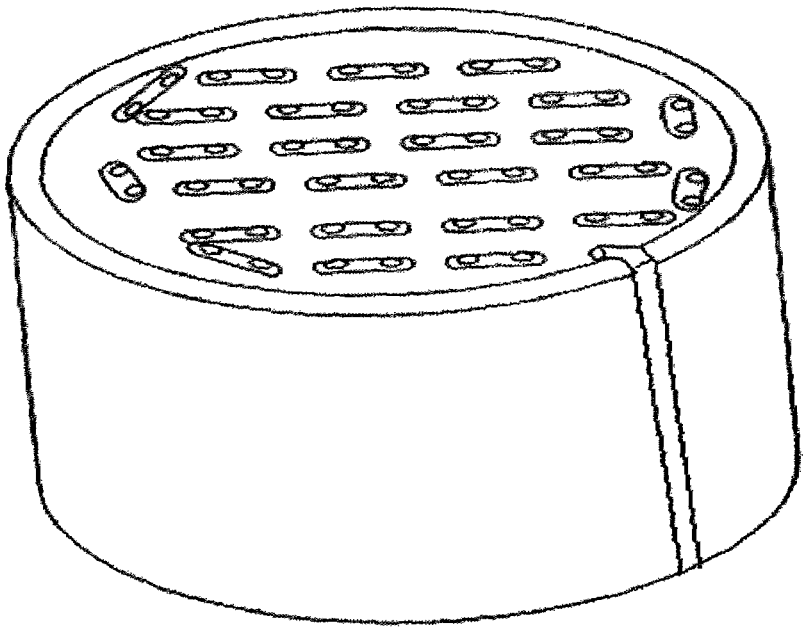
FIG. 6 is a structural scheme according to Embodiment 3.

Refer to FIG. 6, the embodiment 3 differs from Embodiment 1 in that the body is in a cylindrical shape, and that the number of the tubular holes is 27.

The above descriptions of the invention only aim at clearly describing the technical solutions of the invention, which shall not be construed as any limitation to the present invention. Various substitutions or changes of the invention generally known in the technical field, without departing from the essence of the present invention, shall fall into the scope of protection of the invention.

The invention claimed is:

1. A combined firework comprising:

a body in which a plurality of tubular holes whose central longitudinal axes are parallel to each other are uniformly distributed, the tubular holes having openings upward and bottom ends closed, the closed end of the bottom of each tubular hole being provided with two small through holes penetrating through the bottom of the body;

an inward fuse and an outward fuse provided for each of the two small through holes, the inward fuse of each tubular hole respectively being connected with the outward fuse of another adjacent tubular hole in sequence to form a series connection, except the inward fuse of the tubular hole at the head of the series connection and the outward fuse of the tubular hole at the end of the series connection, the inward fuse of the tubular hole at the head of the series connection extending out of the bottom of the body as an ignition fuse;

the body, the tubular holes and the small through holes thereof being an integrally molded structure; and propellant powder being provided on the bottom in each tubular hole and connecting the outward fuse with the inward fuse, an inner cylinder or effect powder being provided on the propellant powder.

2. The combined firework according to claim 1, wherein the outward fuse of the tubular hole at the end of the series connection extends out of the bottom of the body as a backup ignition fuse.

3. The combined firework according to claim 1, wherein the tubular holes have a consistent size and shape.

4. The combined firework according to claim 1, wherein bottom wiring grooves are provided on the bottom of the body between the openings of the small through hole for inward fuse and the small through hole for outward fuse of two adjacent tubular holes for connecting the two openings.

5. The combined firework according to claim 1, wherein a sidewall wiring groove for the ignition fuse is provided on the sidewall of the body.

6. The combined firework according to claim 1, wherein the bottom of the body is provided with a supporting structure.

7. The combined firework according to claim 1, wherein the bottom of the body is provided with a protective layer.

8. The combined firework according to claim 7, wherein the protective layer is formed by LDPE film.

9. The combined firework according to claim 1, wherein sidewalls and top of the body are provided with protective layers formed by BOPP film.

10. The combined firework according to any one of claims 1-9, wherein the small through hole for inward fuse and the small through hole for outward fuse of the two adjacent tubular holes are connected by a length of fuse folded into a U shape.

* * * * *